US011195361B2

(12) United States Patent
Bergmann

(10) Patent No.: US 11,195,361 B2
(45) Date of Patent: Dec. 7, 2021

(54) SYSTEM FOR MONITORING A PERSON

(71) Applicant: Muehlbauer GmbH & Co. KG, Roding (DE)

(72) Inventor: Mike Bergmann, Dresden (DE)

(73) Assignee: MUEHLBAUER GMBH & CO. KG, Roding (DE)

( * ) Notice: Subject to any disclaimer, the term of this patent is extended or adjusted under 35 U.S.C. 154(b) by 0 days.

(21) Appl. No.: 16/755,126

(22) PCT Filed: Oct. 4, 2018

(86) PCT No.: PCT/EP2018/076973

§ 371 (c)(1),
(2) Date: Apr. 9, 2020

(87) PCT Pub. No.: WO2019/072672

PCT Pub. Date: Apr. 18, 2019

(65) Prior Publication Data

US 2020/0320813 A1 Oct. 8, 2020

(30) Foreign Application Priority Data

Oct. 11, 2017 (DE) ..... 102017009430.6

(51) Int. Cl.
*G07C 9/26* (2020.01)
*G07C 9/25* (2020.01)

(52) U.S. Cl.
CPC ..... *G07C 9/257* (2020.01)

(58) Field of Classification Search
CPC .. G07C 9/257; H04W 12/06; H04W 12/0602; H04W 12/0605; H04W 12/0608;
(Continued)

(56) References Cited

U.S. PATENT DOCUMENTS 9,679,428 B2 6/2017 Arpin et al.
2010/0164680 A1 7/2010 Yancey et al.
(Continued)

FOREIGN PATENT DOCUMENTS

DE 102004048403 A1 4/2006
DE 102010016098 A1 9/2011
(Continued)

OTHER PUBLICATIONS

Martinel, Niki & Micheloni, Christian, Re-identify people in wide area camera network, IEEE Computer Society Conference on Computer Vision and Pattern Recognition Workshops. (2012), 31-36.
(Continued)

*Primary Examiner* — Hai Phan
*Assistant Examiner* — Anthony D Afrifa-Kyei
(74) *Attorney, Agent, or Firm* — John A. Miller; Shumaker, Loop & Kendrick, LLP

(57) ABSTRACT

A system for monitoring a person, for example a traveler, who is moving through a facility or a building and carries a biometric travel document and various electronic devices, for example mobile telephones, laptops, tablet computers, e-readers, notebooks, wireless headphones, smartwatches, or fitness trackers. An electronic controller communicates with an input device for inputting contents of the biometric travel document and for forwarding the contents for further processing. An electronically operated database generates a feature space in which the device characteristics are entered by the transceivers as a digital imprint of the traveler and which identifies the traveler with a particular probability resulting from the ratio of a weighted sum of the individual entries in the feature space to the maximum possible sum.

10 Claims, 1 Drawing Sheet

(58) Field of Classification Search
CPC . H04W 12/0609; G06Q 10/02; G06Q 20/047; G06Q 20/18; G06Q 20/20; G06Q 20/206; G06Q 20/341; G06Q 20/40145; G06Q 50/30; G06F 21/74; G06F 16/22; G06F 17/30312; G06K 9/00892; G06K 19/06037; G06K 19/00; G06K 19/06; G06K 19/06009; G06K 19/06112; G06K 7/1095; G08B 21/0233; H02J 7/0045; H02J 7/35; H02J 7/355; H04B 1/3838; H04B 2001/3894; H04L 63/0861; H05K 9/0007
See application file for complete search history.

(56) References Cited

U.S. PATENT DOCUMENTS

| | | | | |
|---|---|---|---|---|
| 2016/0267760 | A1 | 9/2016 | Trani | |
| 2017/0032485 | A1* | 2/2017 | Vemury | G06Q 50/265 |
| 2017/0148241 | A1* | 5/2017 | Kerning | G08B 25/016 |
| 2019/0012451 | A1* | 1/2019 | Cornick | G06Q 50/30 |

FOREIGN PATENT DOCUMENTS

| | | | |
|---|---|---|---|
| DE | 102012203311 | A1 | 9/2013 |
| WO | 2006029639 | A1 | 3/2006 |
| WO | 2013127624 | A1 | 9/2013 |
| WO | 2013127625 | A1 | 9/2013 |
| WO | 2016188788 | A1 | 12/2016 |
| WO | 2017025193 | A1 | 2/2017 |

OTHER PUBLICATIONS

Dee, Hannah & Velastin, Sergio. How close are we to solving the problem of automated visual surveillance? AAA review of real-world surveillance, scientific progress and evaluative mechanisms. Machine Vision and Applications. (2008), 19. 329-343.
Dantcheva, Antitza & Dugelay, Jean-Luc & Elia, Petros. Person recognition using a bag of facial soft biometrics. (2010). 511-516.
Dantcheva, Antitza & Dugelay, Jean-Luc. Frontal-to-side face re-identification based on hair, skin and clothes patches. (2011).
Henry T.F. Rhodes. Alphonse Bertillon: Father of Scientific Detection, (1956). Abelard-Schuman, Greenwood Press, New York.
A.K. Jain, S. C. Dass and K. Nandakumar. Can soft biometric traits assist user recognition? in Proc. of SPIE, (2004). 561-572. vol. 5404.
Sudhish, P. S.; Jain A. K; Cao, K. Adaptive fusion of biometric and biographic information for identity de-duplication. in Pattern Recognition Letters, (2016). 199-207. vol. 84.
Translation of EPO International Search Report for PCT/EP2018/076973, dated Jan. 15, 2019, 2 pgs.

* cited by examiner

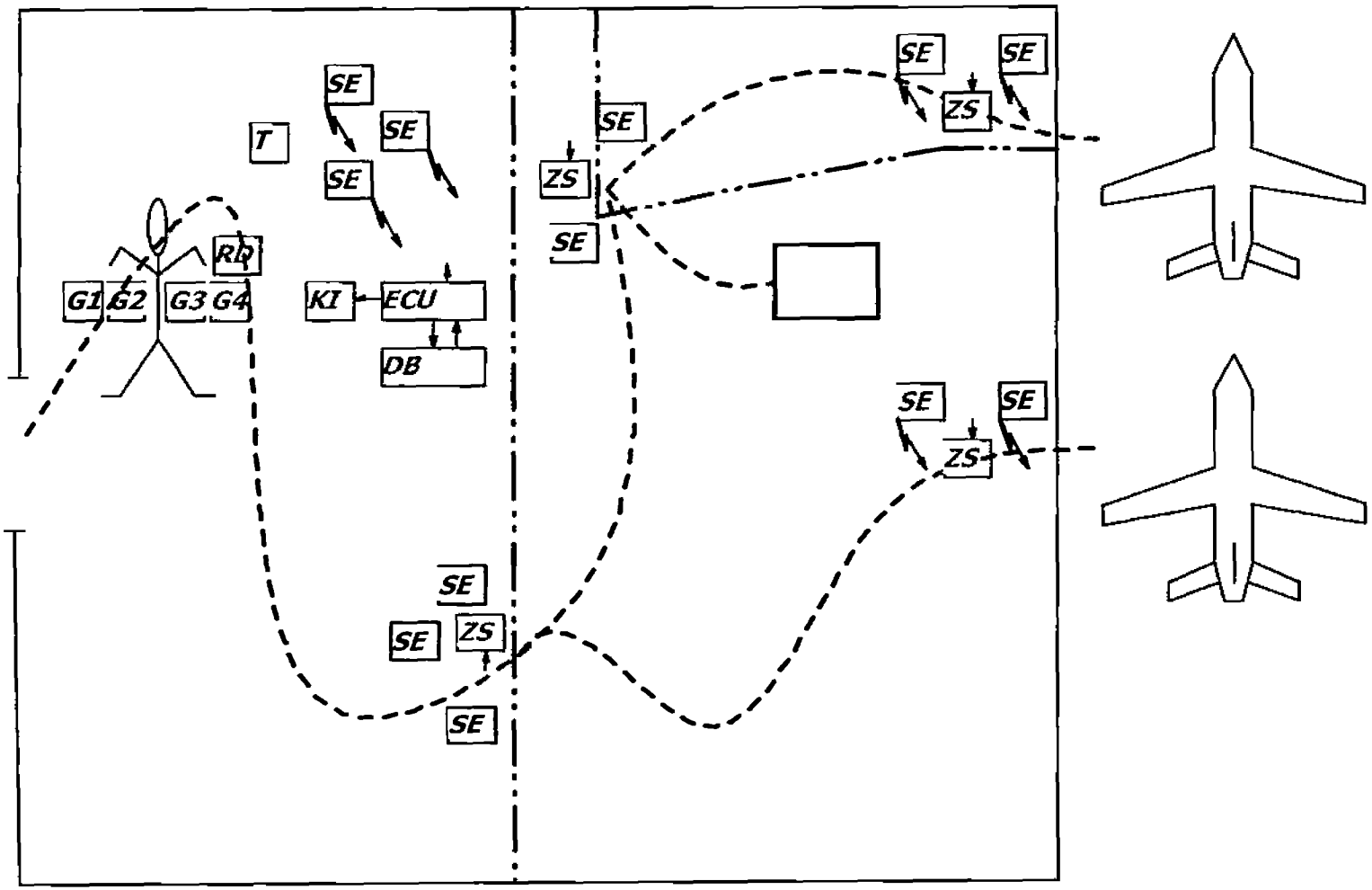
SE
ZS
SE
SE
ZS
SE
SE
ZS
SE
SE
ZS
SE
SE
SE
SE
ECU
DB
KI
T
RP
G1
G2
G3
G4

SYSTEM FOR MONITORING A PERSON

CROSS-REFERENCE TO RELATED APPLICATIONS

This application is a National Stage application of International Application No. PCT/EP2018/076973 filed Oct. 4, 2018, which claims priority to German Patent Application Serial No. DE 10 2017 009 430.6, filed Oct. 11, 2017.

BACKGROUND

Field

A system and a procedure for monitoring a person by means of integrated identity determination for persons, in particular travelers, are described herein. This monitoring of a person by means of integrated identity determination is explained herein in conjunction with a building, for example a railway station or airport. This integrated identity determination for persons serves to control access to specific areas of the building. Details thereof are defined in the claims; the description and the drawing also contain relevant information about the system and its functioning and of variants of the system.

Discussion

Access control devices for airports are known, for example, from DE 10 2004 048 403 A1. Such access control devices are required especially because of the increased security requirements in the airport sector, in order to allow these and the correspondingly more complex checks to be carried out with as low an outlay as possible in terms of personnel and, at the same time, with an increased security standard. A particular problem is that one person may take the place of another between check-in of the air passenger and actual boarding of the aircraft.

From DE 10 2010 016 098 A1 there is known a border crossing control device having a person passage gate that releases or blocks access, which person passage gate has an associated document reading unit and a biometric recording device connected to a control unit of the person passage gate. The biometric recording device is connected to a database. The person passage gate is opened or blocked in dependence on a comparison of the data recorded by the recording device with the data stored in the database. An individual, temporary data set is created in the central database for each passenger and each flight at the time of booking of the flight. The data set contains the booking data of the flight and an identification of the flight procedure and of the flight data set. Further data recorded in the region of a boarding unit that precedes the person passage gate, namely at least a scan of a person-identifying document and one or more fingerprints or a facial image, are entered into the flight data set at the boarding unit, after comparison of the identification of the flight procedure.

The possibility of identifying people by means of facial recognition has also been being investigated for quite some time. Although facial recognition generally works well, there are specific situations in which it fails, such as, for example, in poor lighting, with different headgear and in groups of people where the faces are partly concealed.

In the so-called Easypass system known from practice, a traveler at a person passage gate places his passport or identity card on a scanner. The scanner reads both the personal data and the biometric passport photograph stored on the RFID chip of the document. In the person passage gate, a camera compares the passport photograph with the face of the traveler. In the background, the system compares the traveler with up-to-date wanted lists. If the face matches the biometric passport photograph and there is nothing against the passenger, the gate opens.

Conventional video monitoring systems are based on the evaluation of video images and video sequences. Image contents are thereby analyzed in different ways: (i) Only visual information from the recorded images is used to compute a signature of the person. (ii) The person is segmented from the image content. Features are derived on the basis of the segmentation in order to compute a signature of the person. (iii) The identification of a person is based on the biometric data derived from the image material. All these types of identification require images of a specific quality. In practice, this requirement is found to be problematic, however, since the involvement of the person is necessary for a corresponding quality. In order to compensate for the disadvantages and improve the recognition rate even without the involvement of the person, it has been proposed to take into consideration further non-biometric features which are based on front and side views taking account of the color and texture of the hair, skin and clothing. However, problems with the recognition and identification of people are not ruled out here either if the input data do not meet a specific quality.

Further background information is to be found in the following documents:

U.S. Pat. No. 9,679,428 B2, WO 2006 029 639 A1, WO 2013 127 624 A1, WO 2013 127 625 A1, WO 2016 188 788 A1,

Martinel, Niki & Micheloni, Christian, (2012): Re-identify people in wide area camera network, IEEE Computer Society Conference on Computer Vision and Pattern Recognition Workshops. 31-36. 10.1109/CVPRW.2012.6239203, Dee, Hannah & Velastin, Sergio. (2008). How close are we to solving the problem of automated visual surveillance?: AAA review of real-world surveillance, scientific progress and evaluative mechanisms. Machine Vision and Applications. 19. 329-343. 10.1007/s00138-007-0077-z, Dantcheva, Antitza & Dugelay, Jean-Luc & Elia, Petros. (2010). Person recognition using a bag of facial soft biometrics (BoFSB). 511-516. 10.1109/MMSP.2010.5662074, Dantcheva, Antitza & Dugelay, Jean-Luc. (2011). Frontal-to-side face re-identification based on hair, skin and clothes patches. 10.1109/AVSS.2011.6027342, Henry T. F. Rhodes, Alphonse Bertillon: Father of Scientific Detection, Abelard-Schuman, New York, Greenwood Press, 1956, A. K. Jain, S. C. Dass and K. Nandakumar, "Can soft biometric traits assist user recognition?" in Proc. of SPIE, 2004, vol 5404, pp. 561-572.

Previous solutions are either too uncertain or too time-consuming, cause queues at access gates and frustrate travelers. Starting therefrom, an access control with an improved security standard and increased user convenience is to be provided.

SUMMARY

This problem can be solved with a system for access control according to the features of the claims.

Travelers nowadays carry a large number of electronic devices with them, such as, for example, mobile telephones, laptops, headphones, smartwatches, fitness trackers, etc. These can in some cases be detected even without the involvement of the traveler and analyzed wirelessly at least partially in order to obtain a digital imprint which is characteristic of the respective traveler to a specific degree at least while he is in the building. Today's electronic devices for end users (mobile telephone, smartphone, fitness or health tracker, portable computers, e-readers, tablet computers, notebooks, etc.) have a signature. Thus, for example, by means of the browser signature in a tablet computer, e-reader or other PDA (personal digital assistant), its user can be re-identified. In a comparable manner, it would be possible to read the serial number of the SIM card IMSI (international mobile subscriber identity) from the smartphone by means of IMSI-catcher. Information can also be read wirelessly from a PDA, for example, from so-called "cookies" stored in web browsers (Internet Explorer, Safari, etc.), in order to obtain a signature of the traveler. Thus, for every traveler who enters an airport, for example, a feature space is generated which contains, in addition to the non-biometric or biometric features, further features characteristic of the traveler (i.e. the digital imprint), which together clearly identify the traveler with a specific probability. This feature space is gradually supplemented as the traveler moves through the airport by the recording of further (biometric or non-biometric) characteristics of the traveler. The probability of correct identification of the traveler is then given by the weighted sum of the individual probabilities of the identifying features. It is also possible to determine the probability of correct identification of the traveler from the ratio of the weighted sum of the individual probabilities of the identifying features to the maximum possible sum.

The solution presented herein thereby aggregates different (part) identifications to form an overall identification. For this purpose there are provided at one location or at different locations of the building readers, transceivers and sensors, which the traveler passes on his way through the building/facility. The sensors thereby record the values or output data which are each characteristic of different (part) identifications of a traveler.

These (part) identifications of the traveler are on the one hand his non-biometric or biometric features, as are recorded at passport control, the issuing of a ticket, on passing through a baffle gate monitored by a camera, a stride-length sensor at a gateway, a height sensor or the like, and on the other hand these values are results of targeted communication of the transceiver with the electronic devices carried by the traveler in order to acquire his browser signature, the NFC signature of his smartphone etc. These values or output data are signaled by the respective readers, transceivers and sensors to a central controller, which determines the values or output data for determining the individual values for each of the corresponding features and enters the individual values for each of the corresponding features in the feature space of a traveler in a database.

The more precise identification of a traveler is achieved by combining different features, each of which alone would not sufficiently or would only partially identify the traveler. The combination of biometric features (for example facial features, hair color and style, iris, fingerprint, stride length, height, etc.) and non-biometric features (for example clothing, digital imprint, etc.) makes it possible to determine, as the traveler moves through the monitored area (the building), that, even though the traveler is still carrying the same ticket or the same passport, or the luggage tag with the same barcode tag, his stride length has changed from one monitoring camera to the next. It can also be detected that, even though the traveler's face looks similar on two successive camera recordings, the traveler's mobile telephone has a different signature.

The digital imprint is the combination of the signature[s] of the personal electronic devices (smartwatch, smartphone, fitness tracker, NFC or Bluetooth devices, etc.) which the traveler carries with him as he passes through a person passage gate or the Easypass system, and other biometric or physical parameters, such as hair color, height, clothing, headgear, facial image, etc.

The probability of a reliable identification is then given by the ratio of the weighted sum of the individual probabilities of the identifying features to the maximum possible sum.

For this purpose, the following procedure proposed herein is used:

- Initialization of the feature space in a monitored environment with the features of the traveler. This monitored environment can be the ticket desk at which the traveler presents his travel document.
- Data recording by means of sensors, transceivers and/or readers and provision of the recorded data in a database. The travel document and the flight ticket, for example, are scanned by the reader. At the same time, a front and/or side image of the head or face of the traveler is produced by a camera sensor, for example. In addition, his electronic devices are also scanned by means of corresponding transceivers. On the basis thereof, the initial feature space of the traveler, which contains the non-biometric, technical and further features, is filled. The device characteristics of the devices carried by the traveler are recorded by specific transceivers for the types of device in question. Other features of the traveler, such as stride length, facial image, hair color, height, etc., are recorded by sensors which are likewise specific. The biometric travel document (passport or the like) and optionally also the flight ticket are recorded by means of an input device, for example in the form of a (character) reader. These data are fed to the database for entry of the individual values of the corresponding features in the feature space of the traveler in question.
- Analysis of the data material from the sensors in the feature space by means of processing algorithms which perform preprocessing in order to segment and prepare the data for further analyses.
- Evaluation of the individual features: The results obtained from the preprocessing operation are evaluated and the quality of the features (probabilities) is calculated.
- Aggregation of the evaluations and calculation of the overall quality of the features.
- Signaling to the managing system of a system state in relation to the individual traveler (certain, unclear, uncertain), in order to initiate further actions.
- Further actions: In the case of an insufficiently certain identification of the traveler (the value of the totality of all the features, which is calculated in order to reach a threshold value necessary for sufficient identification, is below the threshold value), an operator is informed, the operator being able to perform manual checks, both on the existing data pool and on the traveler. In the normal case (sufficient identification), the new feature space is initialized and the process begins again with data recording.

Thus, the traveler, on entering the airport, is identified by an identification unit at the ticket desk, or before the ticket desk at the entrance to the building, or even in front of the building, and, for example, the flight reservation is linked with his identity. This is a non-biometric feature of the traveler just like headgear, clothing, presence of digital devices, which are likewise recorded and added to his feature space. This feature space, in its complexity, is much more meaningful than a biometric facial image alone. Therefore, it can also be checked at different locations in the airport much more easily and with less interference in the passage of the traveler through the airport. Queuing at passage controls is thus avoided in many cases. The purely optical, camera-based checks in different lighting conditions can thus also become more meaningful when they are supplemented by further identity comparisons based on other factors (stride length, mobile phone signature, etc.). The security personnel is thus able to carry out an inconspicuous comparison of the electronic documents and certifications without disturbing other passengers, which results in fewer security-related queues and makes the overall process and the transit of people through the facility or the building more free-flowing.

In the recording of data by means of the sensors (transceivers) and provision of the acquired data in the database, the data, in a variant, are stored in the database without probabilities. At a later point in time, these features are recorded by a transceiver and allocated probabilities in the transceiver or by the controller of the database, in order to be compared with the corresponding entries in the feature space.

The solution presented herein and its variants are more efficient compared with the prior art, because they permit a higher transit of travelers through a building, minimize queues and nevertheless achieve increased security.

BRIEF DESCRIPTION OF THE DRAWINGS

Further features, properties, advantages and possible modifications will become clear to a person skilled in the art from the following description, in which reference is made to the accompanying drawings.

FIG. 1 shows, in a schematic plan view, a building or a facility in the form of, by way of example, an airport in which the solution presented herein is implemented.

DETAILED DESCRIPTION OF THE EMBODIMENTS

The solution presented herein will be explained in greater detail hereinbelow by means of an exemplary embodiment shown only schematically in the drawing. The arrangement shown in FIG. 1 is a schematic plan view of a building in which, by way of example, the solution presented herein is implemented.

The starting point is that a traveler, who is able to move through the building along the routes shown by broken lines, carries with him a biometric travel document RD in the form of a biometric passport, which contains as information I the surname, forename/s, sex, date of birth, place of birth, nationality, height, photograph, issuing authority, date of issue, date of expiry, ID number and type of ID, data chip with facial image and fingerprints, signature, machine-readable zone, and also various electronic devices G1 . . . Gn, for example mobile telephone, laptop, tablet computer, e-reader, wireless headphones, smartwatch, fitness tracker, etc. The building is divided into predetermined areas which the traveler may not enter or leave at all or may enter or leave only after his identity and/or his authorization have been checked. These predetermined areas are delimited from one another by the double dot-dash lines. Access to the predetermined area of the building is released or blocked for the traveler by access gates ZS, in dependence on checks of the traveler.

The access gate may be a baffle gate which travelers pass through one at a time without having to present their travel documents for checking.

Instead, the system presented herein has an electronic controller ECU, which is adapted to communicate with various transceivers SE. Each of these transceivers SE serves to establish contact wirelessly with one or more of the electronic devices G1 . . . Gn carried by the traveler when the traveler is in the immediate vicinity of these transceivers SE. The transceivers SE can thus detect electronic devices G1 . . . Gn carried by the traveler and analyze them at least partially wirelessly in order to acquire device characteristics GK of the devices G1 . . . Gn. These device characteristics GK are characteristic of the respective traveler to a specific degree at least while he is in the building. These device characteristics GK can be, for example, in the case of Bluetooth devices their individual and unique 48-bit long MAC address or the browser signature in a tablet computer, e-reader or other personal digital assistant, or the serial number IMSI stored in the SIM card of the smartphone. The transceivers SE are each able and adapted to record one or more device characteristics GK. For this purpose they each have a local controller which is capable, for example, of managing communication with a Bluetooth device of the traveler, or of communicating with a PDA of the traveler in order to read an IMSI of a telephone SIM card contained therein, etc.

At an entrance gate or a desk for checking in the traveler there is provided an input device T, in which on the one hand the flight ticket and on the other hand also the biometric travel document RD of the passenger are read and the contents of which are forwarded to the electronic controller ECU for further processing. Moreover, by means of the various transceivers SE, device characteristics GK of the electronic devices G1 . . . Gn of the traveler are recorded and, optionally, photographs or measurements (e.g. stride length, etc.) of the traveler are recorded by means of sensors and likewise forwarded to the electronic controller ECU. This electronic controller ECU processes the data obtained and enters them in an electronically operated database DB. In the database DB, a feature space MR is generated for each traveler, in which the device characteristics GK are entered by the transceivers SE as the digital imprint of the traveler. By means of this digital imprint, that is to say the totality of the currently available device characteristics GK for a particular traveler, there is calculated in the database DB for the traveler a specific probability p with which the traveler is to be identified. This probability p can be calculated, for example, from the ratio of a weighted sum of the individual entries of the feature space MR to the maximum possible sum. Other calculations of the weightings are possible/conceivable.

When the traveler passes the various transceivers SE in the building, the device characteristics GK of his electronic devices G1 . . . Gn are recorded, photographs, stride length, etc. of the traveler are optionally generated and likewise signaled to the electronic controller ECU to the controller ECU of the database DB. In one variant this takes place with, and in another variant without, the associated (individual) or overall weightings of the recorded data. These data are then compared with the previous entries in the feature space of the traveler. If the more recent recorded data have a better probability p with which the traveler is to be identified, these more recent recorded data can also replace the corresponding previous data in the feature space of the traveler.

Thus, as soon as the traveler enters the building, an initialization of the feature space generated for him with biometric data and non-biometric data takes place in a monitored environment.

For the inputting and for the later comparison of the data, the data of the traveler are subjected to preprocessing in order to segment and prepare them for further analysis. In addition, the individual features of the feature space are evaluated by calculating the quality of the individual features.

In one configuration of the system, (part) identifications of the traveler from his non-biometric and/or biometric features are aggregated with the digital imprint of the traveler in the feature space MR to form an overall identification. For this purpose, all or parts of the information I of the biometric travel document RD are also inputted by the input device T into the feature space MR.

The sensors and transceivers SE are arranged at one location or different locations inside the building close to the predetermined areas and record at least non-biometric and parts of the digital imprint of the traveler when the traveler enters the vicinity of one of those predetermined areas. These parts of the digital imprint of the traveler are signaled to the database DB and correspondingly weighted in order to initiate a comparison of those parts with the corresponding entries in the feature space MR of the traveler. Depending on the result of the comparison, the access gates ZS to the predetermined area of the building are released or blocked for that traveler.

As soon as the traveler reaches one of the access barriers ZS to a predetermined area of the building, for example the check-in area, device characteristics GK of the electronic devices G1 . . . Gn and also, optionally, photographs of the traveler are recorded by means of the various transceivers SE located there. Depending on the check of the entries in the feature space of the person with the device characteristics GK obtained by the various transceivers SE in the region of the access barrier ZS in question, that predetermined area is released or blocked for the traveler.

The input device T comprises, in addition to a display unit, for example, a barcode scanner or a document reader with which, in addition to a 2D barcode of a boarding card or of a ticket printed at home, the chip of a personal identification document, that is to say, for example, of a passport, can be read in respect of the biometric image or the RFID data. This document reader can also read out and recognize the machine-readable data of the personal identification document.

At the input device T, the traveler is required to prove his identity; the creation of the feature space MR of the traveler in the database DB is then initiated by the input device T. A fingerprint reader for one or more fingerprints can also be provided in order to record the fingerprints of the traveler. Finally, the travel document (passport or the like) is also read and entered with the data of the flight ticket in the feature space MR of the traveler in the database DB.

The traveler is then given a signal to proceed on his way through the building, that is to say, for example, that his check-in process is complete and he should proceed to the departure gate.

In the region of hand luggage control, it is then no longer necessary for the traveler to show his boarding card; device characteristics GK of the electronic devices G1 . . . Gn and optionally photographs of the traveler are recorded by means of the various transceivers SE located there and compared with the data of the feature space of the traveler. The photographs can thereby be taken without the traveler being required to look into a camera in order to prepare a facial image. Instead, required features are recorded and compared with the features in the feature space without the cooperation of the traveler. The previously generated digital imprint is compared with the digital imprint stored in the database DB (by a transceiver SE, via an input device T, etc.) in a pattern recognition. In the case of a positive outcome of the comparison, the traveler can pass through the area and hand luggage control. In the case of a negative outcome of the comparison, security personnel correspondingly informed by the database DB can clarify the situation with the traveler. This can all take place without the traveler having had to stop for identification.

The weighting of the individual features and of the overall image is to have the effect that

- strong ID features are more heavily included in the overall result
- a three-valued logic is possible (Yes, it is certain "1"; No, it is not certain "0"; the feature could not be recorded (not known))
- values other than "not known" are real numbers/R; 0<=x<=1
- weaker ID features can be aggregated with certainty Specialist knowledge for identification is thus stored in a quantifiable manner and is thus usable. Other than in the case of neural networks, the decision paths are mathematically replicable. The solution presented here is based on the feature space, from which a feature vector is derived. As in a neural network or in fuzzy logic, this is used as the input value and parameterized via weightings in order to calculate a value for the probability of a person belonging to an identity.

| Feature | Result | Evaluation | Interpretation |
|---|---|---|---|
| Face recognized? | 60% of face recognized | 1.0 Extremely important | Face can be concealed, if it is recognized, then it is the main ID factor |
| Hair color matches? | 100% match | 0.8 Important | As a supplement to the face. In case of doubt, these features are added. |
| Hair style matches? | 95% match | 0.8 Important | As a supplement to the face. In case of doubt, these features are added. |
| Clothing matches? | 80% match | 0.5 Less important | As a supplement to the face. In case of doubt, these features are added. |
| Make of mobile telephone | 100% match | 0.5 Less important | As a plausibility check - if the make does not match |

-continued

| Feature | Result | Evaluation | Interpretation |
|---|---|---|---|
| | | | then it is probably not him. |
| Mobile device MAC address | 100% match | 0.8 Important | If the facial recognition is uncertain and the other features are not available, the MAC address can be used. |
| Electronic feature (NFC signature) | Could not be recorded | 0.5 Less important | As a plausibility test - if the signature does not match then it is probably not him. |
| eMRTD signature | 100% match | 0.25 not important | Weak feature which is shared by many system participants |
| | | . . . | |

The aggregation specification is a multi-step logic with a fallback option, similar to a procedure in the case of a fuzzy logic.

Rule 1: Only known data are processed (three-valued logic: 1 . . . 0, not known).

Rule 2: Weighted probabilities are processed. The weightings are determined empirically in order to give particular weight to specific features (e.g. the face). The value range of the weightings is usually $0<W_i\leq 1$ but could also be $W_i>1$ in order to give weight to individual values disproportionately. Weights with $W_i=0$ are theoretically possible but not meaningful, because the corresponding feature is thereby completely equalized.

Rule 3: The result "digital imprint DA is the ratio of the sum of the weighted features $W_i x_i$ to the sum of those weightings $W_i$ whose feature value is not "not known":

$$DA = \frac{\text{sum of the weighted features } W_i x_i}{\text{sum of the weightings } W_i \text{ whose feature value is not "not known"}}$$

$W_i$ = weighting of feature $i$;

$x_i$ = value of feature $i$.

Rule 4: A threshold value is to be specified, above which DA can be assumed to identify the traveler. The following guide values apply for the threshold value:

1.0: all measurable features $x_i$ were determined with 100% certainty. The traveler has been identified without doubt.

0.75: overall, the $x_i$ give a high probability of identification of the traveler, even if individual features in some circumstances are allocated lower values.

0.5: the $x_i$ are weak and could have arisen by guesswork/by chance.

0.25: overall, the $x_i$ give a high probability of non-identification.

0.0: the person is with 100% certainty not the traveler to be identified.

According to the rules, the following configuration is obtained for the example:

| Feature | $x_i$ | $W_i$ |
|---|---|---|
| Facial features | 0.6 | 1 |
| Hair color | 1 | 0.8 |
| Hair style | 0.95 | 0.8 |
| Clothing | 0.8 | 0.5 |

-continued

| Feature | $x_i$ | $W_i$ |
|---|---|---|
| E-feature 1 - make of telephone | 1 | 0.5 |
| E-feature 2 - MAC address | 1 | 0.8 |
| E-feature 3 - NFC signature | | 0.5 |
| E-feature 4 - eMRTD signature | 1 | 0.25 |
| Relative sum DA | | 0.884 |

Thus, despite poor results of the facial recognition, the person is identified with certainty. Even if the weighting for the face is raised significantly (e.g. to factor 5), a value of DA=0.753 would be calculated for DA as a result of the other features determined with a high degree of certainty ($x_i>0.75$), which still represents a high probability of identification.

The analysis and processing of the data can be as follows, that is to say, for example:

| Feature | Markedness | Probability | Weighting | Result |
|---|---|---|---|---|
| Facial features | Clearly visible | 0.8 | 1 | 0.8 |
| Hair color | Mid-brown | 1 | 0.5 | 0.5 |
| Style | Short | Not known | 0.5 | — |
| Clothing | Red jacket, jeans, scarf | 0.9 | 0.75 | 0.675 |
| Electronic imprint | "0x3A5B6 . . . C8D" | 1 | 1 | 1 |
| Overall result: | | | | 0.846 |

As a result of this aggregation of features, an identification can still be made with a certain degree of probability if, in a subsequent recording of the traveler, the face is concealed, that is to say, for example:

| Feature | Markedness | Probability | Weighting | Result |
|---|---|---|---|---|
| Facial features | Scarcely visible | 0.1 | 1 | 0.1 |
| Hair color | Mid-brown | 1 | 0.5 | 0.5 |
| Style | Short | 1 | 0.5 | 0.5 |
| Clothing | Red jacket, jeans, scarf | 0.9 | 0.75 | 0.675 |
| Electronic imprint | "0x3A5B6 . . . C8D" | 1 | 1 | 1 |
| Overall result: | | | | 0.74 |

The values for the weighting are here only by way of example. If 0.75 is defined as the threshold value, for example, security personnel as the supervisory body are informed, for example, and a manual verification or identification of the traveler may be carried out.

The above-described variants of the system and its structural and operational aspects serve merely for better understanding of the structure, the mode of functioning and the properties; they do not limit the disclosure, for example, to the exemplary embodiments. The FIG. is schematic, whereby essential properties and effects are in some cases shown on a significantly enlarged scale in order to clarify the functions, active principles, technical configurations and features. Any mode of functioning, any principle, any technical configuration and any feature that is/are disclosed in the figures or in the text can be combined freely and arbitrarily with all the claims, any feature in the text and in the other figures, other modes of functioning, principles, technical configurations and features which are contained in this disclosure or follow therefrom, so that all conceivable combinations of the described system are to be included. Combinations between all the individual implementations in the text, that is to say in every section of the description, in the claims, and also combinations between different variants in the text, in the claims and in the figures, are also included. The claims also do not limit the disclosure and thus the possible combinations of all the indicated features with one another. All the disclosed features are explicitly also disclosed herein individually and in combination with all the other features.

The invention claimed is:

1. A system for monitoring a person, for example a traveler, who is moving through a facility or a building and carries with him a biometric travel document and also various electronic devices, for example mobile telephones, laptops, tablet computers, e-readers, notebooks, wireless headphones, smartwatches, fitness trackers, wherein the system has an electronic controller which is intended and adapted to communicate with:

an input device for inputting information of the biometric travel document and forwarding the information for further processing;

access barriers to predetermined areas of the facility or building in order to release or block those predetermined areas for the traveler in dependence on checks of the traveler;

transceivers for detecting the electronic devices carried by the traveler and at least partially wirelessly analyzing them in order to acquire from each of the devices device characteristics which are characteristic of the particular traveler to a specific degree at least while he is in the building; and an electronically operated database which is adapted and programmed to generate for each traveler a feature space in which, in addition to the information of the biometric travel document, the device characteristics are entered by the transceivers as a digital imprint of the traveler, and which identifies the traveler with a specific probability given by a weighted sum of individual entries of the feature space, and, when in the further process the electronic devices carried by the traveler are newly detected by the transceivers, to compare newly recorded data recorded in the database with the previous entries in the feature space and, if the newly recorded data have a better probability with which the traveler is to be identified, to replace the corresponding previous data in the feature space by the newly recorded data, wherein preprocessing of the data of the traveler is carried out in order to segment and prepare the data for further analyses, and in order to evaluate the individual features of the feature space by calculating the quality of the individual features, and wherein the calculation of the quality of the individual features is configured to be used in the weighted sum of individual entries of the feature space which gives the specific probability of the identification of the traveler.

2. The system for monitoring a person as claimed in claim 1, which aggregates (part) identifications of the traveler from his non-biometric or biometric features with the digital imprint of the traveler to form an overall identification, in that the information of the biometric travel document is also entered in the feature space by the input device.

3. The system for monitoring a person as claimed in claim 2, in which specific transceivers for particular types of devices record the data characteristics of the devices carried by the traveler, specific sensors for biometric or non-biometric features record the biometric or non-biometric features of the traveler, and/or the input device records the biometric travel document and/or a flight ticket.

4. The system for monitoring a person as claimed in claim 1 wherein the transceivers are arranged at different locations within the facility or the building close to one of the predetermined areas and record at least parts of the digital imprint of the traveler, signal those parts to the database in order to initiate a comparison of those parts with the feature space of the traveler, and in order, in dependence on the result of the comparison, to effect the release or blocking of the access barriers to the predetermined area of the facility or of the building for that traveler.

5. The system for monitoring a person as claimed in claim 2 wherein an initialization of the feature space with the biometric data and non-biometric data of the traveler takes place in a monitored environment.

6. The system for monitoring a person as claimed in claim 1 wherein after aggregation of the evaluations and calculation of an overall quality of the individual features, a signal is given to a monitoring authority in relation to the individual traveler in order to initiate further actions.

7. A method for monitoring a person, for example a traveler, who is moving through a facility or a building and carries with him a biometric travel document and also various electronic devices, for example mobile telephones, laptops, tablet computers, e-readers, notebooks, wireless headphones, smartwatches, fitness trackers, in which an electronic controller communicates with:

an input device in which information of the biometric travel document is inputted and forwarded for further processing;

access barriers to predetermined areas of the facility or building in order to release or block those predetermined areas for the traveler in dependence on checks of the traveler;

transceivers for detecting the electronic devices carried by the traveler and at least partially wirelessly analyzing them in order to acquire from each of the devices device characteristics which are characteristic of the particular traveler to a specific degree at least while he is in the building; and an electronically operated database which is adapted and programmed to generate for each traveler a feature space in which, in addition to the information of the biometric travel document, the device characteristics are entered by the transceivers as a digital imprint of the traveler, and which identifies the traveler with a specific probability given by a weighted sum of individual entries of the feature space, and, when in the further process the electronic devices carried by the traveler are newly detected by the transceivers, to compare newly recorded data recorded in the database with the previous entries in the feature space and, if the newly recorded data have a better probability with which the traveler is to be identified, to replace the corresponding previous data in the feature space by the newly recorded data, wherein preprocessing of the data of the traveler is carried out in order to segment and prepare the data for further analyses, and in order to evaluate the individual features of the feature space by calculating the quality of the individual features, and wherein the calculation of the quality of the individual features is configured to be used in the weighted sum of individual entries of the feature space which gives the specific probability of the identification of the traveler.

8. The method for monitoring a person as claimed in claim 7, which aggregates (part) identifications of the traveler from his non-biometric or biometric features with the digital imprint of the traveler to form an overall identification, in that the information of the biometric travel document is also entered in the feature space.

9. The method for monitoring a person as claimed in claim 7, in which the transceivers are arranged at different locations within the facility or the building close to one of the predetermined areas and record at least parts of the digital imprint of the traveler, signal those parts to the database in order to initiate a comparison of those parts with the feature space of the traveler, and in order, in dependence on the result of the comparison, to effect the release or blocking of the access barriers to the predetermined area of the facility or of the building for that traveler.

10. The method for monitoring a person as claimed in claim 8 wherein an initialization of the feature space with the biometric data and non-biometric data takes place in a monitored environment, and/or in which, after aggregation of the evaluations and calculation of an overall quality of the individual features, a signal is given to a monitoring authority in relation to the individual traveler in order to initiate further actions.

* * * * *